US007342186B2

(12) United States Patent
Montalvo et al.

(10) Patent No.: US 7,342,186 B2
(45) Date of Patent: Mar. 11, 2008

(54) KNOB FORCE TRANSFER MODULE

(75) Inventors: Juan J. Montalvo, Juarez (MX); Cristian D. Delamora, Juarez (MX)

(73) Assignee: Delphi Technologies, Inc., Troy, MI (US)

( * ) Notice: Subject to any disclaimer, the term of this patent is extended or adjusted under 35 U.S.C. 154(b) by 7 days.

(21) Appl. No.: 11/484,491

(22) Filed: Jul. 11, 2006

(65) Prior Publication Data

US 2008/0011590 A1 Jan. 17, 2008

(51) Int. Cl.
*H01H 19/00* (2006.01)
*H01H 19/11* (2006.01)
*H01H 19/58* (2006.01)

(52) U.S. Cl. ..... 200/11 R; 200/564; 200/336

(58) Field of Classification Search ..... 200/11 R
See application file for complete search history.

(56) References Cited

U.S. PATENT DOCUMENTS

| | | | | |
|---|---|---|---|---|
| 4,453,152 | A | 6/1984 | Dob et al. | |
| 4,878,402 | A | 11/1989 | Behringer | |
| 6,114,944 | A | 9/2000 | Kosmidis | |
| 6,621,016 | B2 * | 9/2003 | Ohba et al. | 200/4 |
| 7,012,200 | B2 * | 3/2006 | Moller | 200/11 A |
| 2003/0182809 | A1 * | 10/2003 | Enzinna | 33/1 PT |
| 2003/0214381 | A1 | 11/2003 | Pan | |
| 2005/0224322 | A1 * | 10/2005 | Kikuya et al. | 200/11 R |
| 2005/0284737 | A1 * | 12/2005 | Shitanaka et al. | 200/5 R |

FOREIGN PATENT DOCUMENTS

| | | |
|---|---|---|
| DE | 19853587 | 5/2000 |
| DE | 10261284 | 7/2004 |
| DE | 10341740 | 3/2005 |
| EP | 0702366 | 3/1996 |
| EP | 1102294 | 5/2001 |
| EP | 1518726 | 3/2005 |

* cited by examiner

*Primary Examiner*—Elvin Enad
*Assistant Examiner*—Lheiren Mae A. Anglo
(74) *Attorney, Agent, or Firm*—Jimmy L. Funke

(57) ABSTRACT

A knob assembly comprising a housing, a circuit board, a rotary knob, a rotary actuated potentiometer and a rotation assembly. The housing has a front face. The circuit board is located in the housing, with the circuit board having a front and a rear. The rotary knob extends from the front face of the housing, with the rotary knob being located in front of the circuit board. The rotary actuated potentiometer is connected to the rear of the circuit board. The rotation assembly mechanically transfers a rotation force of the rotary knob to the rotary actuated potentiometer.

9 Claims, 4 Drawing Sheets

KNOB FORCE TRANSFER MODULE

TECHNICAL FIELD

The present invention concerns control assemblies, and more particularly relates to control assemblies having a knob force transfer.

BACKGROUND OF THE INVENTION

Control assemblies using buttons and knobs can be used in a wide variety of applications. For example, buttons can be used in vehicles to control a radio, air conditioning or many other features. Furthermore, the control assemblies can typically be used in any application that has switches actuated by buttons or knobs.

Heretofore, control assemblies have included a rotary knob extending out of a housing and a ring-type potentiometer surrounding a base of the knob within the housing. This potentiometer was used to change the resistance of a circuit to thereby alter the output of the circuit (e.g., raise or lower volume of an audio system, raise or lower the temperature of an HVAC system, etc.) The rotary knob could also include a center push button actuator for actuating a circuit.

An improved control assembly is desired.

SUMMARY OF THE INVENTION

An aspect of the present invention is to provide a knob assembly comprising a housing, a circuit board, a rotary knob, a rotary actuated potentiometer and a rotation assembly. The housing has a front face. The circuit board is located in the housing, with the circuit board having a front and a rear. The rotary knob extends from the front face of the housing, with the rotary knob being located in front of the circuit board. The rotary actuated potentiometer is connected to the rear of the circuit board. The rotation assembly mechanically transfers a rotation force of the rotary knob to the rotary actuated potentiometer.

Another aspect of the present invention is to provide a knob assembly comprising a housing, a circuit board, a rotary knob, a rotary actuated potentiometer, a rotation assembly and a push button. The housing has a front face. The circuit board is located in the housing, with the circuit board having a front and a rear. The circuit board has a push button actuator for actuating a circuit on the circuit board. The rotary knob extends from the front face of the housing, with the rotary knob being located in front of the circuit board. The rotary actuated potentiometer is connected to the rear of the circuit board. The rotation assembly transfers a rotation force of the rotary knob to the rotary actuated potentiometer. The push button is located within the rotary knob. The push button is configured to slide within the rotary knob to abut the push button actuator to thereby actuate the circuit on the circuit board.

Yet another aspect of the present invention is to provide a method of controlling an electronic component comprising providing a housing having a front face and a circuit board located in the housing, with the circuit board having a front and a rear. The method also includes locating a rotary knob in front of the circuit board, connecting a rotary actuated potentiometer to the rear of the circuit board, and mechanically transferring a rotary force of the rotary knob to the rotary actuated potentiometer.

These and other aspects, objects, and features of the present invention will be understood and appreciated by those skilled in the art upon studying the following specification, claims, and appended drawings.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
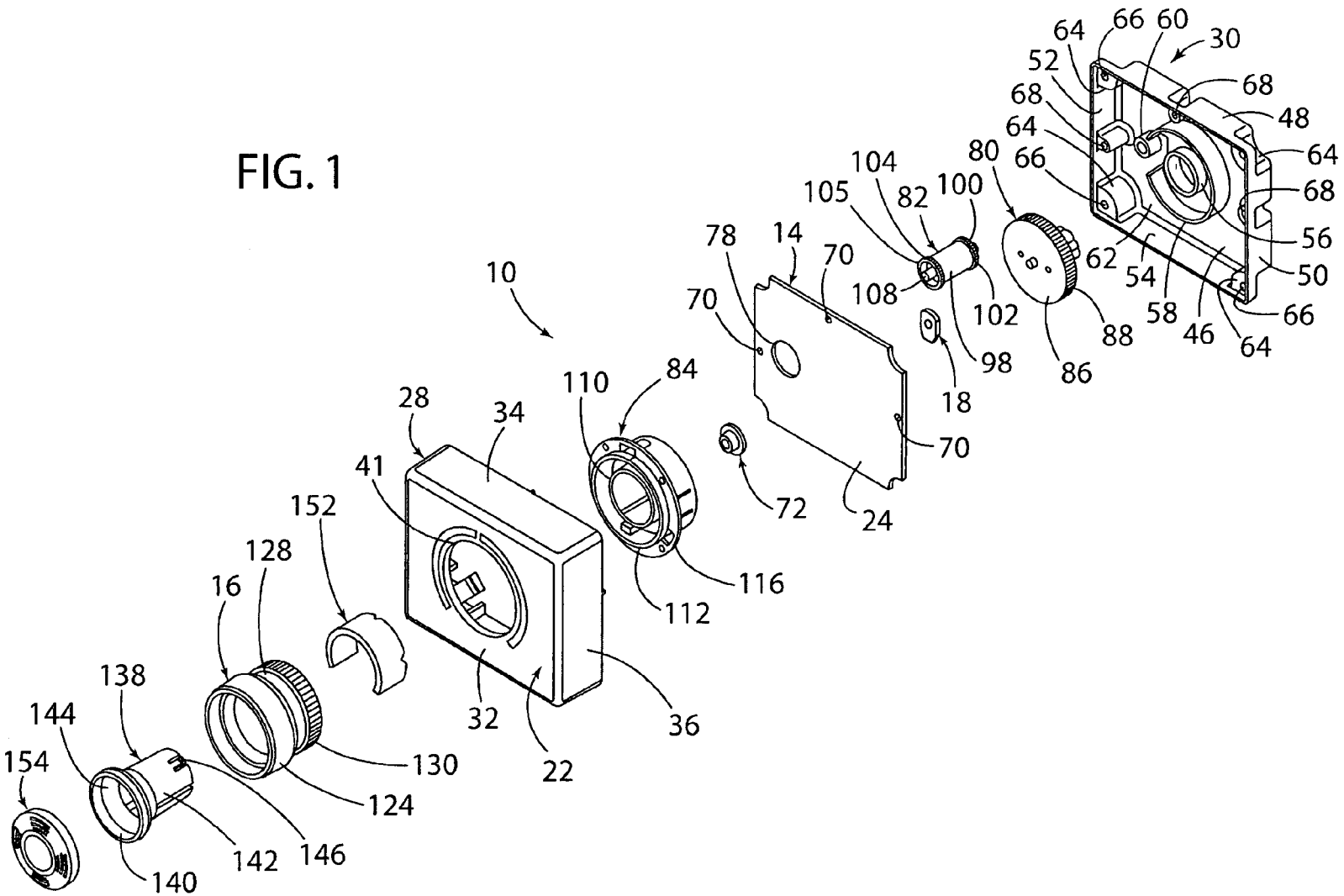
FIG. 1 is an isometric exploded view of a knob assembly of the present invention.

For purposes of description herein, orientation terms shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIGS. 1-2) generally designates a knob assembly embodying the present invention. In the illustrated example, the knob assembly 10 comprises a housing 12, a circuit board 14, a rotary knob 16, a rotary actuated potentiometer 18 and a rotation assembly 20. The housing 12 has a front face 22. The circuit board 14 is located in the housing 12, with the circuit board 14 having a front 24 and a rear 26. The rotary knob 16 extends from the front face 22 of the housing 12, with the rotary knob 16 being located in front of the circuit board 14. The rotary actuated potentiometer 18 is connected to the rear 26 of the circuit board 14. The rotation assembly 20 mechanically transfers a rotation force of the rotary knob 16 to the rotary actuated potentiometer 18.

The illustrated knob assembly 10 is preferably used in a vehicle to control at least one of the electronic components of the vehicle. For example, the knob assembly 10 can be used to control an audio system, a heating, ventilating and air-conditioning system (HVAC), a navigation system, an infotainment system or any other system. The housing 12 of the knob assembly 10 is preferably a module having a front module portion 28 and a rear module portion 30. However, the housing 12 of the knob assembly could include only one module portion, a pair of side module portions, or any part of the vehicle (or other location of the knob assembly) itself. The module is preferably configured to be installed into a corresponding slot for receiving the module in an instrument panel of the vehicle.

Figure 2:
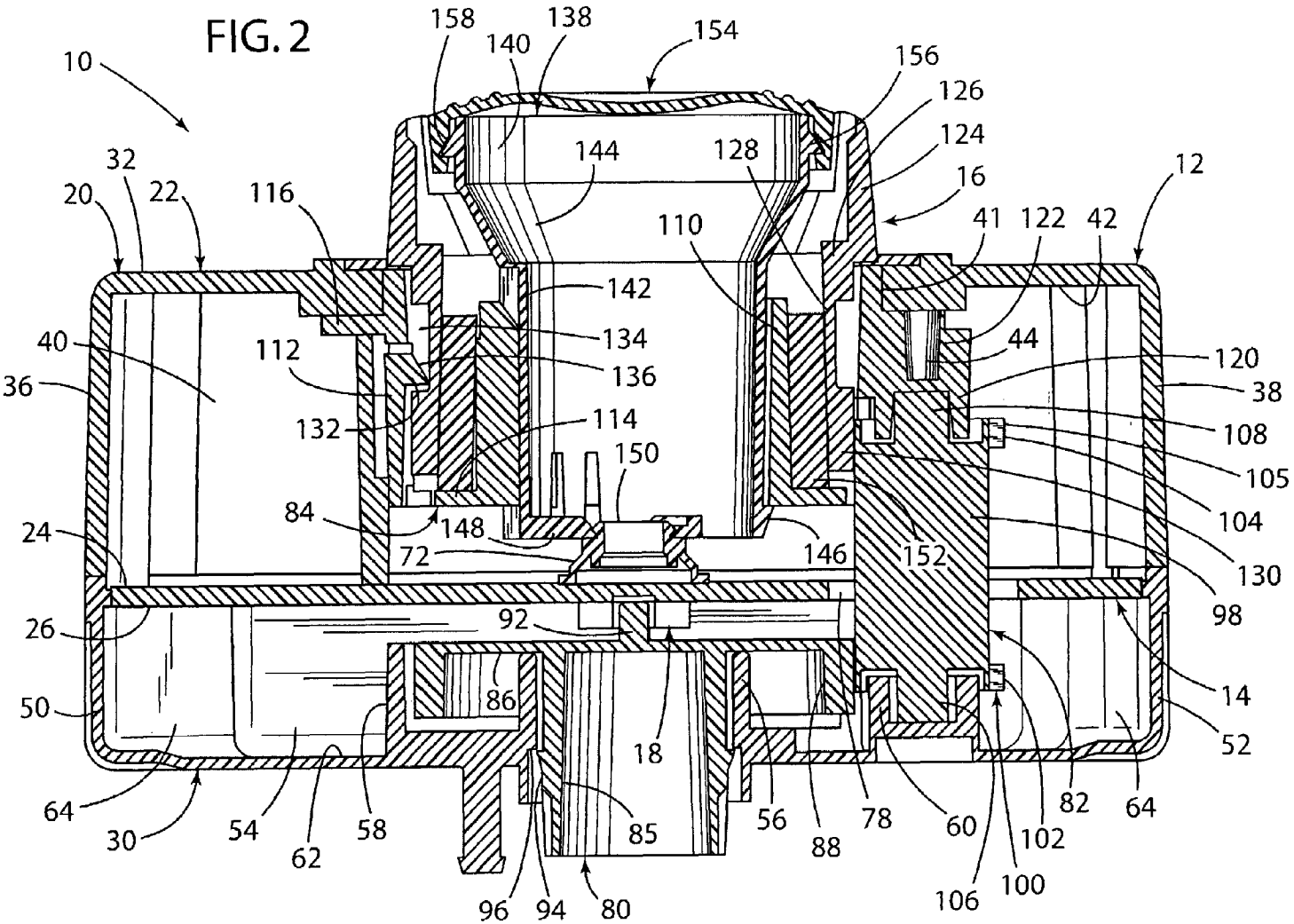
FIG. 2 is a cross-sectional view of the knob assembly of the present invention.

In the illustrated embodiment, the housing 12 includes the front module portion 28 and the rear module portion 30. The front module portion 28 includes a front wall 32 defining the front face 22 of the housing 12, a top wall 34, a first side wall 36, a second side wall 38 and a bottom wall 40. The front face 22 includes an aperture 41. As illustrated in FIG. 2, a rear 42 of the front wall 32 includes a pin 44 for engaging with a knob shell 84 as discussed in more detail below. The front module portion 28 also includes a plurality of fastener slots (not shown) for connecting the front module portion 28 to the rear module portion 30.

The illustrated rear module portion 30 of the housing 12 is connected to the front module portion 28 of the housing 12. The rear module portion 30 includes a rear wall 46, a top wall 48, a first side wall 50, a second side wall 52 and a bottom wall 54. The rear wall 46 includes an inner ring flange 56, a semi-circular flange 58 and a circular gear housing 60 extending forwardly from an inside face 62 of the rear wall 46. The inner ring flange 56, the semi-circular flange 58 and the circular gear housing 60 are configured to engage portions of the rotation assembly 20 as discussed in more detail below. The top wall 48, the first side wall 50, the second side wall 52 and the bottom wall 54 define four corners of the rear module portion 30 and are interconnected by four channels 64. Each channel 64 provides clearance for fasteners to be extended through an opening 66 in the rear wall 46 of the rear module portion 30 for connecting the rear module portion 30 to the front module portion 28 of the housing 12. The rear module portion 30 also includes circuit board fastener openings 68 for accepting fasteners therein for connecting the circuit board 14 to the rear module portion 30.

In the illustrated example, the circuit board 14 is located within the housing 12 and includes circuits printed thereon for controlling the audio system, the heating, ventilating and air-conditioning system (HVAC), the navigation system, the infotainment system or any other system. The circuit board 14 is preferably double sided. The circuit board 14 includes small openings 70 adjacent a periphery thereof for accepting fasteners therein (which are also accepted into the circuit board fastener opening 68) for connecting the circuit board 14 to the housing 12. However, it is contemplated that the circuit board 14 could be interconnected to the housing 12 in any manner. The circuit board 14 preferably includes at least one contact (not shown) on a surface thereof for engaging with at least one flexible dome 72 positioned adjacent the front 24 of the circuit board 14. The flexible dome 72 can be depressed to allow a contact of the flexible dome 72 to contact at least one corresponding contact on the circuit board 14 as is well known to those skilled in the art to close a circuit on the circuit board 14. Although only one flexible dome 72 is illustrated, it is contemplated that any number of flexible domes could be employed. The rotary actuated potentiometer 18 is preferably surface mounted to the rear 26 of the circuit board 14. As is well known to those skilled in the art, the rotary actuated potentiometer 18 is used to change the resistance of a circuit to thereby alter the output of the circuit (e.g., raise or lower volume of an audio system, raise or lower the temperature of an HVAC system, etc.) The circuit board 14 includes a large opening 78 for accepting a portion of the rotation assembly 20 therein.

The illustrated rotation assembly 20 is configured to transfer rotary force from the rotary knob 16 to the rotary actuated potentiometer 18 to adjust the rotary actuated potentiometer 18 to a desired resistance. The rotation assembly 20 includes a plate shift gear 80 and a longitudinal gear 82. The rotation assembly 20 is preferably made of plastic, although other materials are contemplated (e.g., metal). The plate shift gear 80 comprises a center cylinder 85, a front circular plate 86 connected to a front of the center cylinder 85, and a cylindrical gear 88 with teeth 90 connected to the periphery of the front circular plate 86 and extending rearwardly therefrom. The front circular plate 86 further includes a front pin 92. The plate shift gear 80 is connected to the rear module portion 30 of the housing 12 by inserting the center cylinder 85 into the inner ring flange 56 extending from the rear wall 46 of the rear module portion 30 as illustrated in FIG. 2. The center cylinder 85 includes at least one tab 94 that engages a shelf 96 in the inner ring flange 56 to maintain the center cylinder 85 within the inner ring flange 56. In this position, an end of the inner ring flange 56 also abuts against the rear surface of the front circular plate 86 of the plate shift gear 80. The front pin 92 is inserted into the rotary actuated potentiometer 18. Therefore, rotation of the plate shift gear 80 rotates the front pin 92 to thereby adjust the rotary actuated potentiometer 18 to a desired resistance.

In the illustrated example, the longitudinal gear 82 engages the teeth 90 of the cylindrical gear 88 of the plate shift gear 80 to rotate the plate shift gear 80. The longitudinal gear 82 includes a tube 98, a first geared end 100 with first teeth 102 and a second geared end 104 with second teeth 105. The longitudinal gear 82 further includes a first end pin 106 and a second end pin 108. The longitudinal gear 82 is positioned within the housing 12 by inserting the tube 98 through the large opening 78 in the circuit board 14. Furthermore, the first end pin 106 is inserted into the circular gear housing 60 of the rear wall 46 of the rear module portion 30. When in position, the first teeth 102 on the first geared end 100 engage the teeth 90 of the cylindrical gear 88 of the plate shift gear 80. Therefore, rotation of the longitudinal gear 82 will cause the plate shift gear 80 to rotate. The second teeth 105 of the second geared end 104 of the longitudinal gear 82 engage with the rotary knob 16 to transmit rotation of the rotary knob 16 to the plate shift gear 80 via the longitudinal gear 82.

Figure 3:
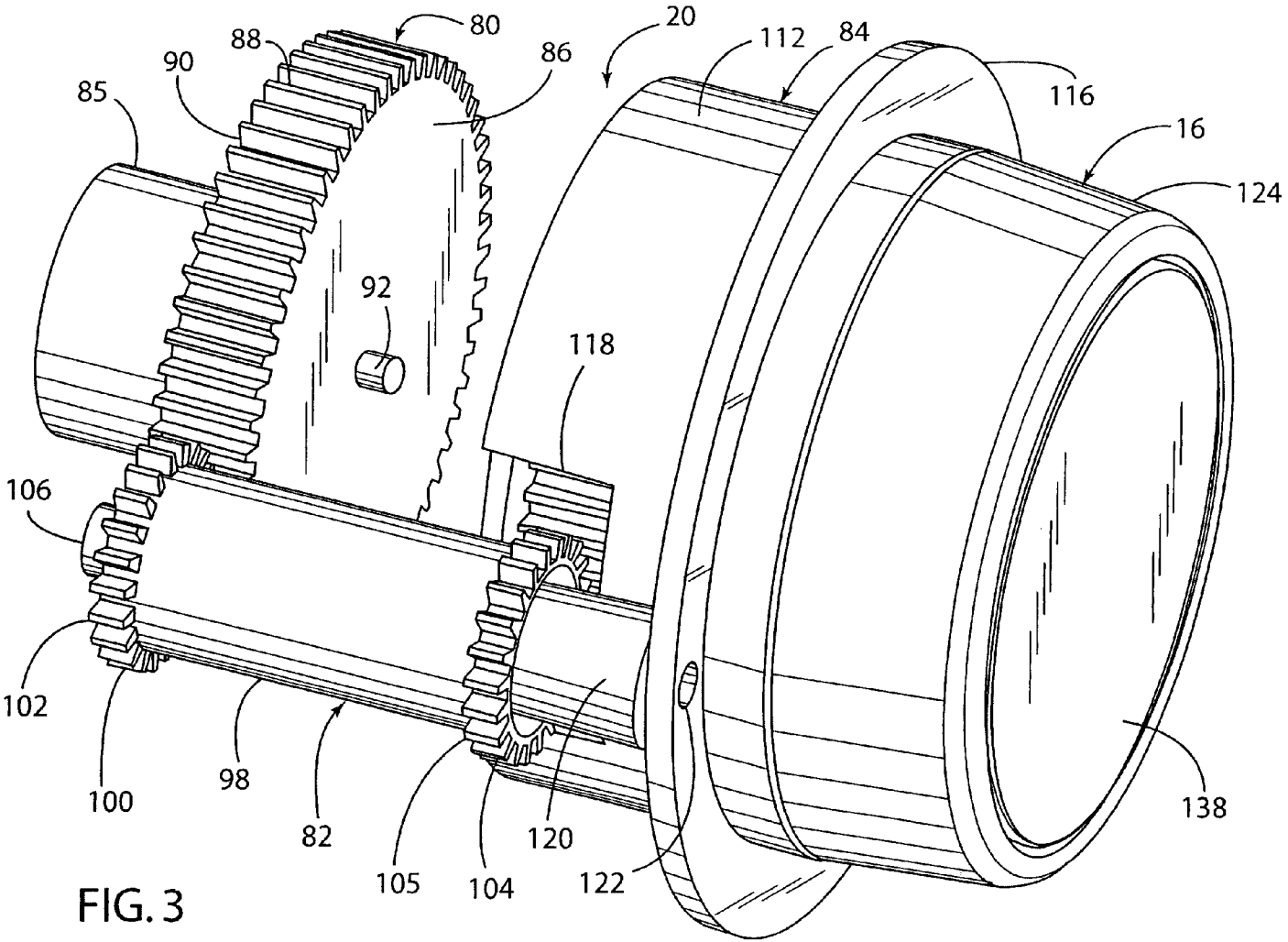
FIG. 3 is a front isometric view of a rotary knob, a push button and a rotation assembly of the knob assembly of the present invention.
Figure 4:
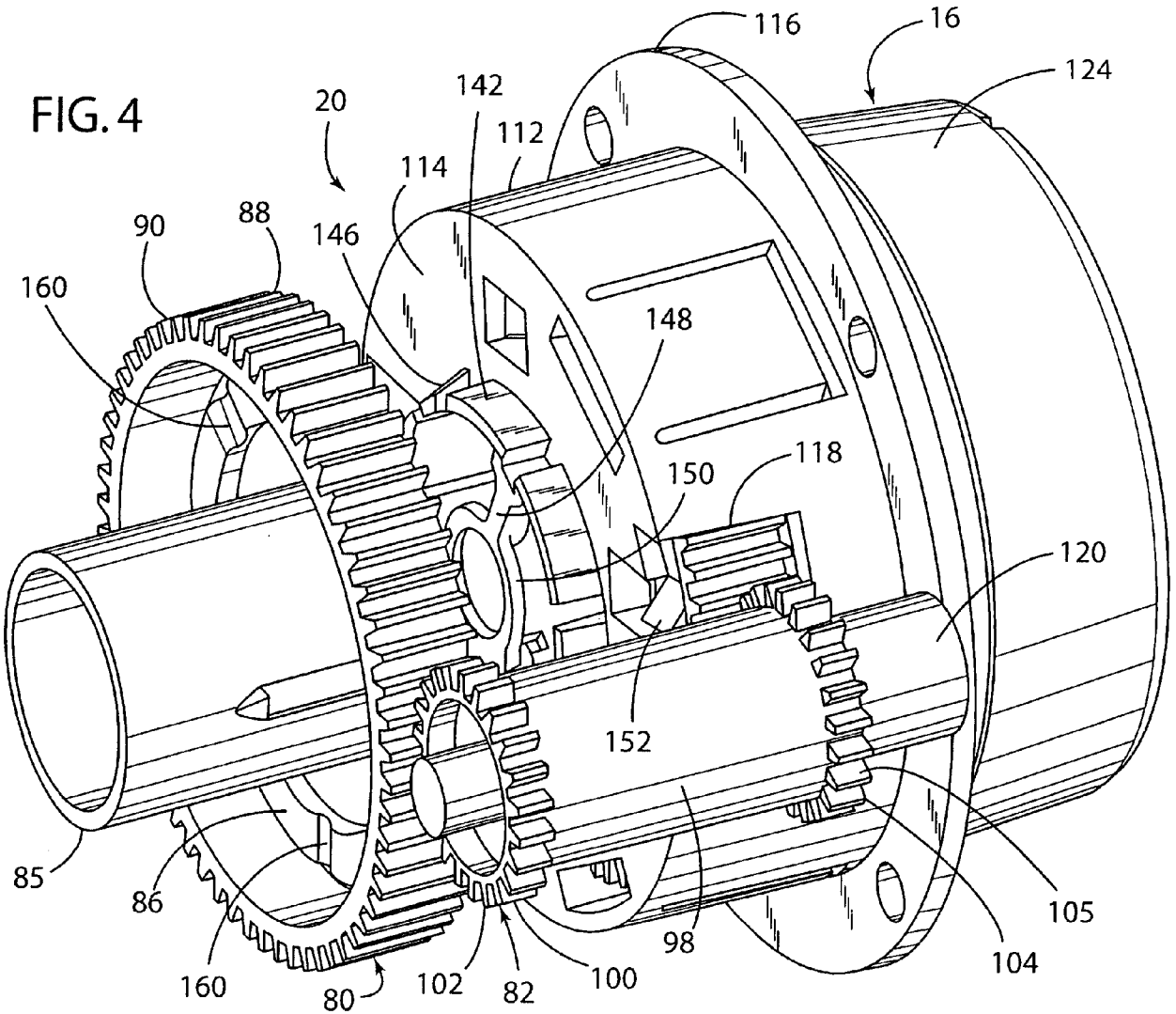
FIG. 4 is a rear isometric view of the rotary knob, the push button and the rotation assembly of the knob assembly of the present invention.

The illustrated knob assembly 10 includes a knob shell 84 that engages with the rotary knob 16 and the longitudinal gear 82 to rotate the plate shift gear 80. The knob shell 84 is preferably made of plastic, although other materials are contemplated (e.g., metal). The knob shell 84 includes an inner cylinder 110, an outer cylinder 112, an annular plate 114 connecting a rear of the inner cylinder 110 to the outer cylinder 112, and an annular flange 116 extending from a periphery of the outer cylinder 112. As illustrated in FIGS. 3 and 4, the knob shell 84 includes a gear slot 118 in the outer cylinder 112 and a portion of the annular plate 114. The annular plate 114 further includes a cylindrical pin housing 120 extending rearwardly therefrom adjacent the gear slot 118. Furthermore, the annular plate 114 includes a pin hole 122 aligned with the cylindrical pin housing 120. The knob shell 84 extends through the aperture 41 in the front face 22 of the front module portion 28. The pin 44 extending from the rear 42 of the front wall 32 of the front module portion 28 extends into the pin hole 122 to prevent rotation of the knob shell 84. The second end pin 108 of the longitudinal gear 82 extends into the cylindrical pin housing 120 of the knob shell 84. Therefore, the longitudinal gear 82 is configured to rotate about an axis defined by the second end pin 108 in the cylindrical pin housing 120 of the knob shell 84 and the first end pin 106 in the circular gear housing 60 of the rear wall 46 of the rear module portion 30. The knob shell 84 is configured to accept the rotary knob 16 between the inner cylinder 110 and the outer cylinder 112. It is contemplated that the knob shell 84 could be fixed to the housing 12 or be part of the housing 12.

In the illustrated example, the rotary knob 16 can be rotated to transfer rotary force to the rotary actuated potentiometer 18 via the rotation assembly 20. The rotary knob 16 is preferably made of plastic, although other materials are contemplated (e.g., metal). The rotary knob 16 includes a front tube portion 124, a transition portion 126 and a rear tube portion 128. As illustrated in FIG. 2, the rear tube portion 128 of the rotary knob 16 is inserted between the inner cylinder 110 and the outer cylinder 112 of the knob shell 84, with the front tube portion 124 abutting a front of the outer cylinder 112 of the knob shell 84. Furthermore, an inner surface of the outer cylinder 112 of the knob shell 84 includes at least one projection 132 configured to be inserted into a circular slot 134 on an outer surface of the rear tube portion 128 of the rotary knob 16. Therefore, the rotary knob 16 is connected to the knob shell 84 by inserting the rear tube portion 128 between the inner cylinder 110 and the outer cylinder 112 of the knob shell 84. As the rear tube portion 128 abuts the at least one projection 132, a ramped front surface 136 of the at least one projection 132 abuts against the end of the rear tube portion 128 to bend the rear tube portion 128 inward until the at least one projection 132 can fit within the circular slot 134. Therefore, the rotary knob 16 can rotate within the knob shell 84. The rear tube portion 128 includes knob teeth 130 on an end thereof. The knob teeth 130 engage the second teeth 105 of the second geared end 104 of the longitudinal gear 82 through the gear slot 118 in the knob shell 84.

Accordingly, according to the knob assembly 10 of the present invention, rotation of the rotary knob 16 transmits rotary force to the rotary actuated potentiometer 18. Rotation of the rotary knob 16 causes the knob teeth 130 thereon to rotate. The knob teeth 130 will thereafter transfer rotary motion to the second teeth 105 of the second geared end 104 of the longitudinal gear 82 through the gear slot 118 in the knob shell 84, thereby causing the longitudinal gear 82 to rotate. Rotation of the longitudinal gear 82 will cause rotation of the first teeth 102 on the first geared end 100 of the longitudinal gear 82 to rotate the teeth 90 of the cylindrical gear 88 of the plate shift gear 80. Finally, rotation of the plate shift gear 80 rotates the front pin 92 to thereby adjust the rotary actuated potentiometer 18 to a desired resistance. Preferably, rotation of the rotary knob 16 transmits rotary force to the rotary actuated potentiometer 18 via the rotation assembly 20 on a 1:1 rotational basis. However, other rotational bases are contemplated. Furthermore, the inner surface of the front circular plate 86 of the plate shift gear 80 includes a plurality of grooves 160. The grooves 160 are configured to accept pin bullets (not shown) extending from the inside face 62 of the rear wall 46 of the rear module portion 30 between the inner ring flange 56 and the semicircular flange 58. The pin bullets extend into the grooves 160 as the plate shift gear 80 is rotated when the pin bullets are aligned with the grooves 160. Therefore, a person rotating the rotary knob 16 will encounter a detent feel to the rotary knob 16 (via the rotation assembly 20) when the pin bullets extend into the grooves 160. Accordingly, the person rotating the rotary knob 16 will know when the rotary knob 16 is rotated to a particular position (e.g., between three settings: fan low, fan medium, and fan high). It is contemplated that other methods of providing a detent feel could be used (e.g., a spring leaf with corresponding slots).

The rotary assembly 10 of the illustrated invention includes at least one push button 138 located within the rotary knob 16, with the push button 138 being configured to slide within the rotary knob 16 to abut the flexible dome 72 to thereby actuate a circuit on the circuit board 14. The push button 138 includes a front tube 140, a rear tube 142 and an angled section 144 between the front tube 140 and the rear tube 142. The push button 138 is inserted into the rotary knob 16 and into the inner cylinder 110 of the knob shell 84. The rear tube 142 includes a plurality of prongs 146 at an end thereof that snap under an end of the inner cylinder 110 of the knob shell 84 to maintain the push button 138 within the knob shell 84. As illustrated in FIG. 4, a plurality of spokes 148 with a central hub 150 extend from the rear of the rear tube 142 of the push button 138. The central hub 150 is configured to abut against the flexible dome 72, with the flexible dome 72 biasing the central hub 150 and the rest of the push button 138 outwardly. In order to actuate a circuit on the circuit board 14, the push button 138 is depressed, thereby forcing abutment of the central hub 150 with the flexible dome 72 and forcing the contact of the flexible dome 72 into engagement with a corresponding contact on the circuit board 14 to complete the circuit. Preferably, the push button 138 is used to toggle a system controlled by the circuit on and off. However, other functions of the push button 138 are contemplated. It is further contemplated that that a light pipe 152 could be located between the inner cylinder 110 and the knob shell 84 that would light when the push button 138 is activated. The light pipe 152 can be illuminated by an LED on the circuit board 14 in a manner well known to those skilled in the art. Furthermore, a knob cap 154 can be located at an end of the front tube 140 of the push button 138 and connected thereto by accepting prongs 156 on the front tube 140 into corresponding slots 158 on the knob cap 154.

Accordingly, the knob assembly 10 of the present invention is configured to activate the rotary actuated potentiometer 18 located on the rear of the circuit board 14 using a rotary knob 16 and also to include the push button 138 located within the rotary knob 16 that can be used to actuate a circuit on the front of the circuit board 14.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The invention claimed is:

1. A knob assembly comprising:

a housing, the housing having a front face;

a circuit board located in the housing, the circuit board having a front and a rear;

a rotary knob extending from the front face of the housing, the rotary knob being located in front of the circuit board;

a rotary actuated potentiometer connected to the rear of the circuit board; and a rotation assembly for mechanically transferring a rotation force of the rotary knob to the rotary actuated potentiometer, wherein the rotation assembly comprises a shift gear engaged with the rotary actuated potentiometer and a longitudinal gear extending through the circuit board, and the shift gear includes first teeth; the longitudinal gear includes second teeth and third teeth; and the rotary knob includes fourth teeth; and the first teeth engage the second teeth and the third teeth engage the fourth teeth to transmit rotary force from the rotary knob to the rotary actuated potentiometer.

2. The knob assembly of claim 1, wherein:

the circuit board has a push button actuator for actuating a circuit on the circuit board.

3. The knob assembly of claim 2, further including:

a push button located within the rotary knob, the push button being configured to slide within the rotary knob to abut the push button actuator to thereby actuate the circuit on the circuit board.

4. The knob assembly of claim 1, wherein:

the rotation assembly extends through an opening in the circuit board.

5. The knob assembly of claim 1, wherein:

the housing comprises a module having a front module portion and a rear module portion, the module being configured to be inserted into a slot.

6. A knob assembly comprising:

a housing, the housing having a front face;

a circuit board located in the housing, the circuit board having a front and a rear, the circuit board having a push button actuator for actuating a circuit on the circuit board;

a rotary knob extending from the front face of the housing, the rotary knob being located in front of the circuit board;

a rotary actuated potentiometer connected to the rear of the circuit board;

a rotation assembly for transferring a rotation force of the rotary knob to the rotary actuated potentiometer, wherein the rotation assembly comprises a shift gear engaged with the rotary actuated potentiometer and a longitudinal gear extending through the circuit board, and the shift gear includes first teeth; the longitudinal gear includes second teeth and third teeth; and the rotary knob includes fourth teeth; and the first teeth engage the second teeth and the third teeth engage the fourth teeth to transmit rotary force from the rotary knob to the rotary actuated potentiometer; and a push button located within the rotary knob, the push button being configured to slide within the rotary knob to abut the push button actuator to thereby actuate the circuit on the circuit board.

7. The knob assembly of claim 6, wherein:

the rotation assembly extends through an opening in the circuit board.

8. The knob assembly of claim 6, wherein:

the housing comprises a module having a front module portion and a rear module portion, the module being configured to be inserted into a slot.

9. The knob assembly of claim 6, further including:

a knob shell fixed in position within the housing, the knob shell having the rotary knob therein.

* * * * *